US005619958A

United States Patent [19]

Hampton et al.

[11] Patent Number: 5,619,958

[45] Date of Patent: Apr. 15, 1997

[54] ENGINE VALVE CONTROL SYSTEM USING A LATCHABLE ROCKER ARM

[75] Inventors: Keith Hampton, Ann Arbor; David M. Preston, Clarkston, both of Mich.

[73] Assignee: Eaton Corporation, Cleveland, Ohio

[21] Appl. No.: 681,319

[22] Filed: Jul. 22, 1996

Related U.S. Application Data

[63] Continuation of Ser. No. 540,280, Oct. 6, 1995, abandoned.

[51] Int. Cl.[6] ..... F01L 1/18; F01L 13/00; F02D 13/06

[52] U.S. Cl. ..... 123/90.16; 123/90.41; 123/198 F

[58] Field of Search ..... 123/90.15, 90.16, 123/90.17, 90.27, 90.39, 90.41, 90.43, 90.44, 90.46, 198 F

[56] References Cited

U.S. PATENT DOCUMENTS

| | | | |
|---|---|---|---|
| 4,151,817 | 5/1979 | Mueller | 123/90.16 |
| 4,203,397 | 5/1980 | Soeters, Jr. | 123/90.16 |
| 4,762,096 | 8/1988 | Kamm et al. | 123/90.16 |
| 4,768,475 | 9/1988 | Ikemura | 123/90.16 |
| 5,524,580 | 6/1996 | Muir | 123/90.16 |
| 5,529,033 | 6/1996 | Hampton | 123/90.16 |

*Primary Examiner*—Weilun Lo
*Attorney, Agent, or Firm*—Loren H. Uthoff, Jr.

[57] ABSTRACT

A valve control system for an internal combustion engine. The system includes an outer rocker arm which is engageable with an engine poppet valve, and an inner rocker arm which is engageable with a cam lobe formed in an engine camshaft and a slidable latch member which mechanically links and unlinks the inner and outer rocker arms. The latch member is axially moveable relative to the inner and outer rocker arms between an active position wherein the inner rocker arm engages the outer rocker arm to transmit a valve opening force from the camshaft to the poppet valve, and an inactive position wherein the inner and outer rocker arms are out of engagement and free to rotate relative to one another. The system is adapted for use in a valve train wherein the engine poppet valve remains closed when the inner and outer rocker arms are unlinked when the latch member is in an inactive position and wherein the engine poppet valve opens and closes in response to the cam lobe when the inner and outer rocker arms are linked together when the latch member is in an active position. An actuator operates a bellcrank mechanism which contacts the latch mechanism to move the latch mechanism to an active and an inactive position.

9 Claims, 6 Drawing Sheets

FIG 5
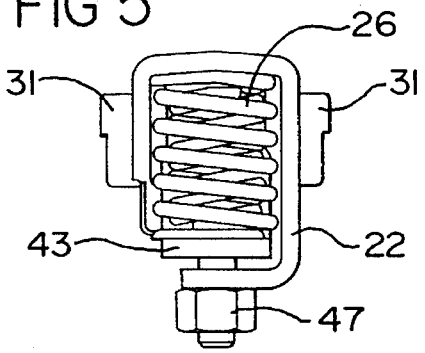
FIG 6
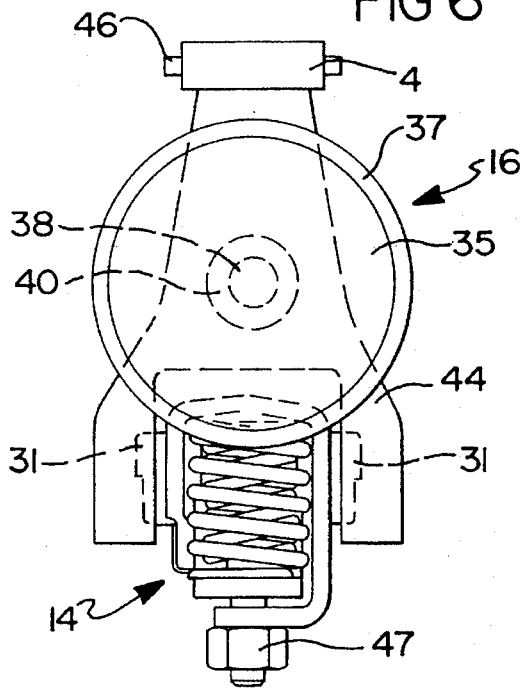
FIG 7
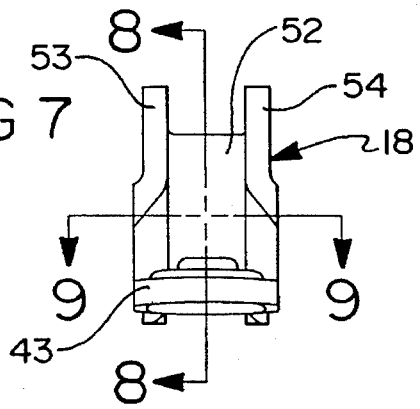
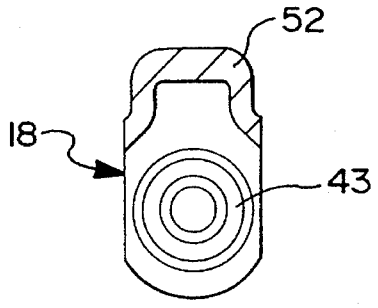
FIG 9
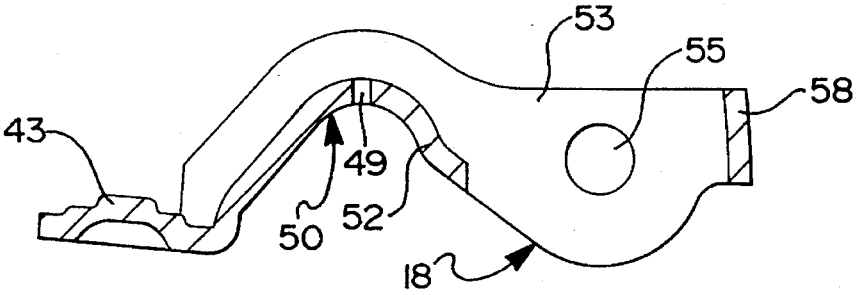
FIG 8

FIG 10
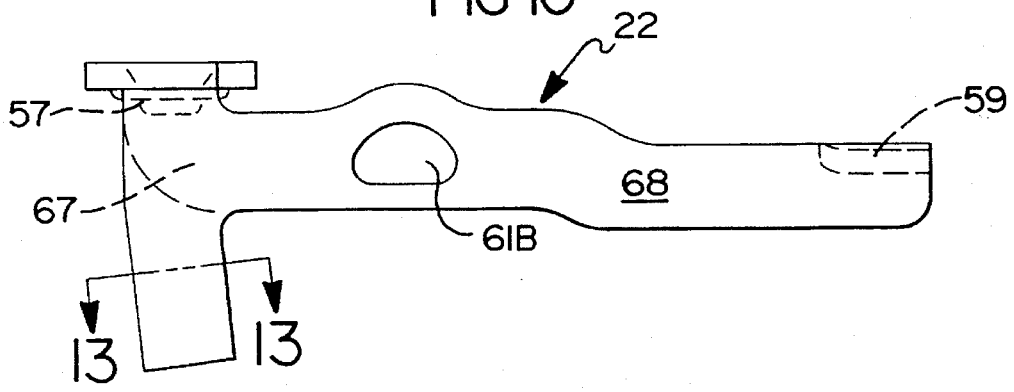
FIG 11
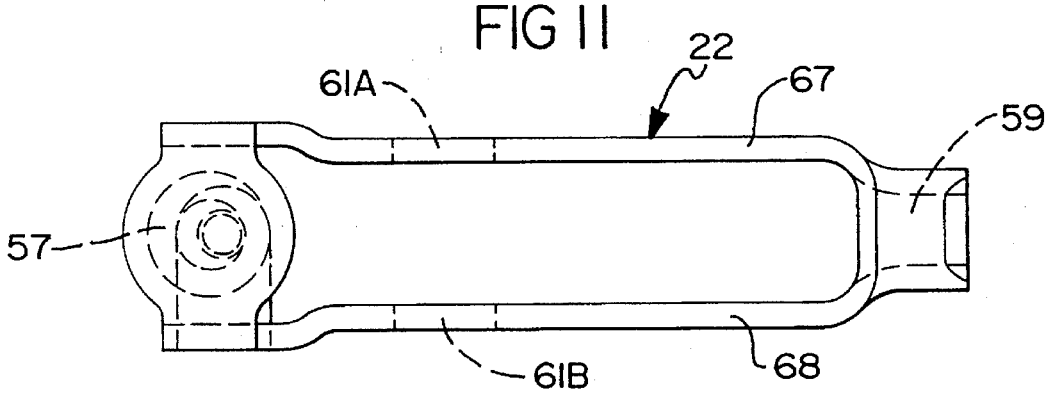
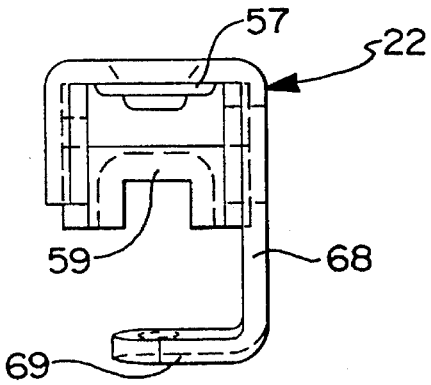
FIG 12
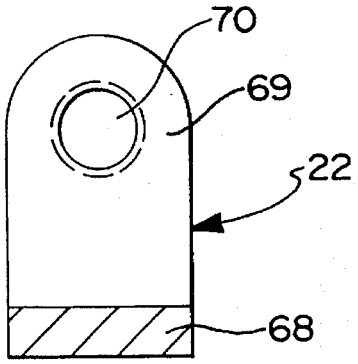
FIG 13

FIG 14
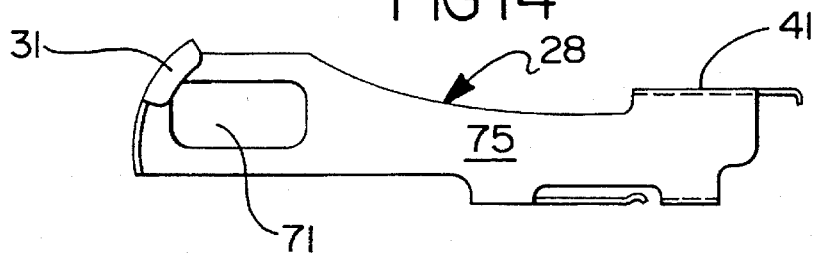
FIG 15
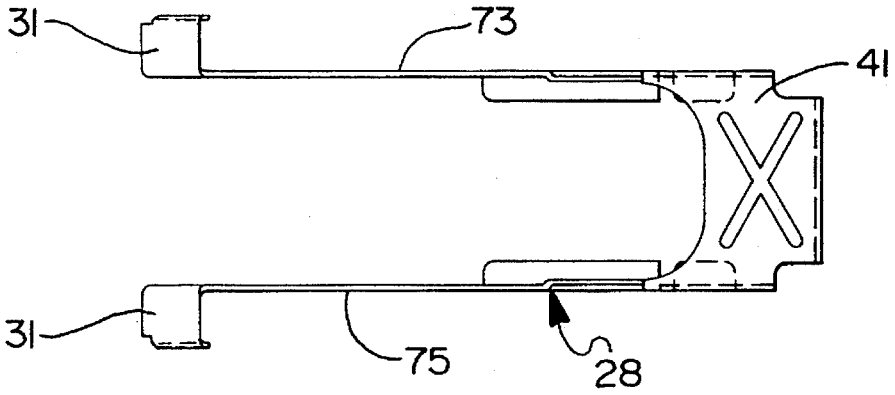
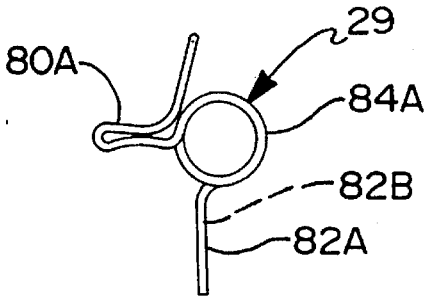
FIG 16
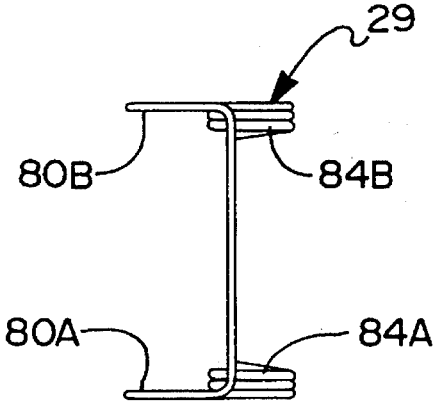
FIG 17

FIG 18
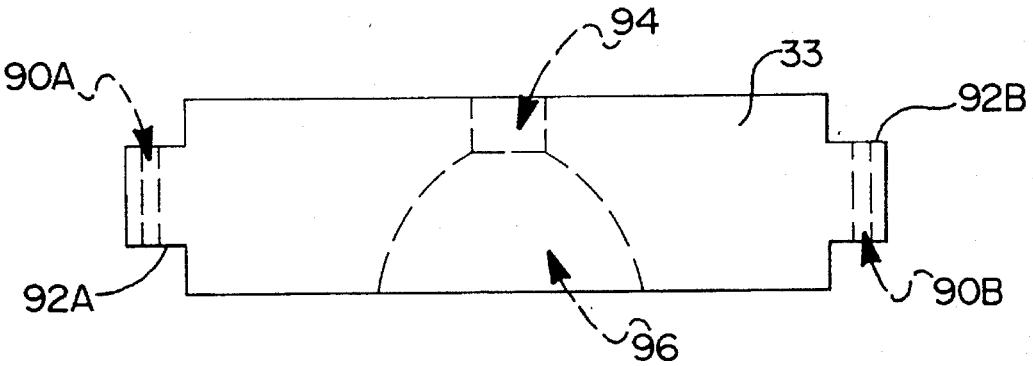
FIG 19
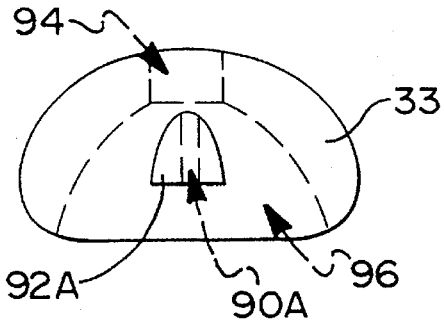
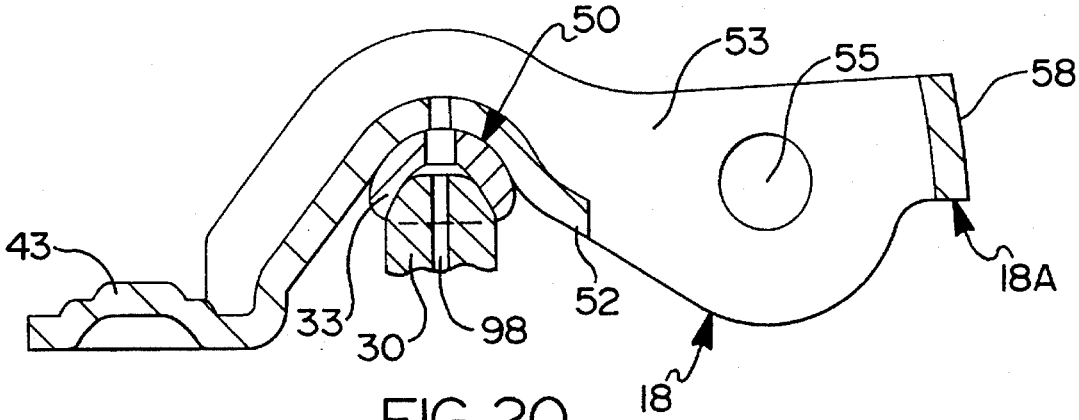
FIG 20

ENGINE VALVE CONTROL SYSTEM USING A LATCHABLE ROCKER ARM

This application is a continuation-in-part of application Ser. No. 08/540,280 filed on Oct. 06, 1995, now abandoned.

RELATED APPLICATION

This application is related to applications U.S. Ser. No.: 08/412,474, filed Mar. 28, 1995 entitled "Valve Control System" and U.S. Ser. No.: 08/452,232, filed May 26, 1995 entitled "Multiple Rocker Arm Valve Control System" assigned to the same assignee, Eaton Corporation, as this application.

BACKGROUND OF THE INVENTION

1. Field of the Invention

The present invention relates to a valve operating apparatus for an internal combustion engine and, more specifically, to apparatus to cause the engine valve to operate or not to operate depending on the energization state of a solenoid actuator.

2. Description of the Prior Art

Variable valve control systems for multiple valve engines wherein the intake and/or exhaust valves can either be selectively actuated or actuated at selected lift profiles, are well known in the art. Example systems are shown in U.S. Pat. Nos. 4,151,817 and 4,203,397 the disclosures of which are hereby incorporated by reference except those portions which also incorporate by reference. U.S. Pat. No. 4,151,817 discloses a primary rocker arm element engageable with a first cam profile, a secondary rocker arm element engageable with a second cam profile, and means to interconnect or latch the primary and secondary arm elements. U.S. Pat. No. 4,203,397 discloses an apparatus to selectively engage or disengage an engine poppet valve so as to connect or disconnect the valve from the rest of the valve gear using a latch mechanism thereby causing the valve to operate or remain stationary.

A particular problem exists in prior art systems which operate a valve train which incorporates hydraulic lash adjusters in that means must be provided to prevent the lash adjuster from overly expanding or "pumping up" when the valve is in its inactive mode and there is essentially no resisting force applied by the valve spring. In prior art systems it has been necessary to provide an auxiliary contact surface on the rocker arm structure which is maintained in engagement with a base circle cam portion formed on the camshaft to prevent the lash adjuster from overly expanding.

Prior art methods and mechanisms tend to be slow in response, bulky, expensive and have high actuation force and are unreliable. Selective valve actuation systems are designed to selectively engage intake and/or exhaust valves to better match the power output of an engine for a motor vehicle to the load for improved efficiency and fuel economy.

SUMMARY OF THE INVENTION

The present invention overcomes the limitations of the prior art by disclosing a valve gear rocker arm which has a selectively latchable rocker arm section that can be disengaged to render the engine poppet valve inoperative or the latchable rocker arm section can be engaged thereby allowing the valve train to operate in a traditional manner.

The present invention discloses a means to solve the hydraulic lifter pump up problem by providing a latchable rocker arm assembly including an inner rocker arm having a roller which contacts the cam; an outer rocker arm which engages the valve, the inner and outer arms being in nesting relation to one another and in pivotal contact with the output plunger of a stationary lash adjuster; and a sliding latch member which is moveable between an active position wherein the inner and outer arms are effectively latched together and operable to actuate the valve, and an inactive position wherein the inner and outer arms are free to move relative to one another and the valve is not actuated. The assembly further includes a biasing spring acting between the inner and outer arms to bias the inner arm into engagement with the cam and into engagement with the plunger of the lash adjuster while the outer arm is engaged with the engine poppet valve. The nested relationship between the inner and outer arms is effective to counteract the plunger spring force to insure that the lash adjuster does not pump up when the rocker arms are in their unlatched condition.

A new type of sliding latch member is disclosed which is slidingly supported on the outer rocker arm which controls the activation of the engine poppet valve by sliding into and out of engagement with the inner rocker arm thereby connecting the inner and outer rocker arms. Contact shoes are formed on the latch member and provide a contact surface against which a pivoted arm (bellcrank) operates to cause the sliding latch member to move against a latch return spring when the camshaft in the base circle position so as to unload the valve train. The bellcrank is moved by means of an electromagnetic solenoid which is powered by a control unit. In this manner, an engine popper valve can be activated or deactivated by a signal from the control unit to optimize engine operations to improve fuel economy and/or emissions.

If the solenoid is energized and the latch member cannot be moved because the cam is not in a base circle position and the valve train is loaded, then a lost motion spring device positioned on an actuator shaft is compressed so that when the valve train unloads, the spring device causes the pivoted arm to move the latch member to deactivate the engine poppet valve.

Other objects and advantages of the invention will be apparent from the following description when considered in connection with the accompanying drawings, wherein:

Figure 4:
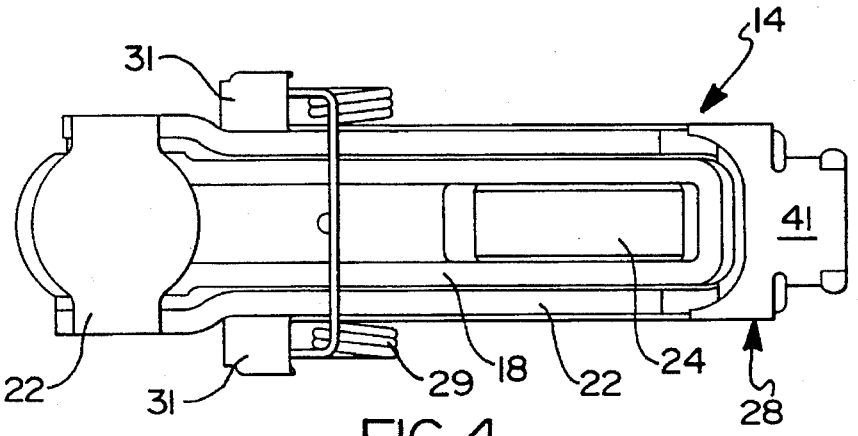

FIG, 3 is a partial perspective view of the rocker arm assembly of the present invention;

FIG. 4 is a plan view of the rocker arm assembly of the present invention;

FIG. 5 is a front elevational view of the rocker arm assembly of FIG. 4;

FIG. 6 is an elevational view of the actuator and rocker arm assembly of the present invention;

FIG. 7 is a front elevational view of the outer rocker arm of the present invention;

FIG. 8 is a sectional view of the outer rocker arm taken along line VIII—VIII of FIG. 7;

FIG. 9 is a sectional view of the outer rocker arm taken along line IX—IX of FIG. 7;

FIG. 10 is a plan view of the inner rocker arm of the present invention;

FIG. 11 is a top elevational view of the inner rocker arm of FIG. 10;

FIG. 12 is an end elevational view of the inner rocker arm of FIG. 10;

FIG. 13 is a sectional view of the inner rocker arm of FIG. 10 taken along line XIII—XIII;

FIG. 14 is a plan view of the latch member of the present invention;

FIG. 15 is a top elevational view of the latch member of FIG. 14;

FIG. 16 is a plan view of the return spring of the present invention;

FIG. 17 is a top elevational view of the return spring of FIG. 16.

FIG. 18 is a cross-sectional view of the link pin of the present invention;

FIG. 19 is an end view of the link pin of the present invention; and

FIG. 20 is a partial cross-sectional view of the inner rocker arm supported on the link pin and the plunger of the present invention.

DETAILED DESCRIPTION OF THE PREFERRED EMBODIMENT

Figure 1:
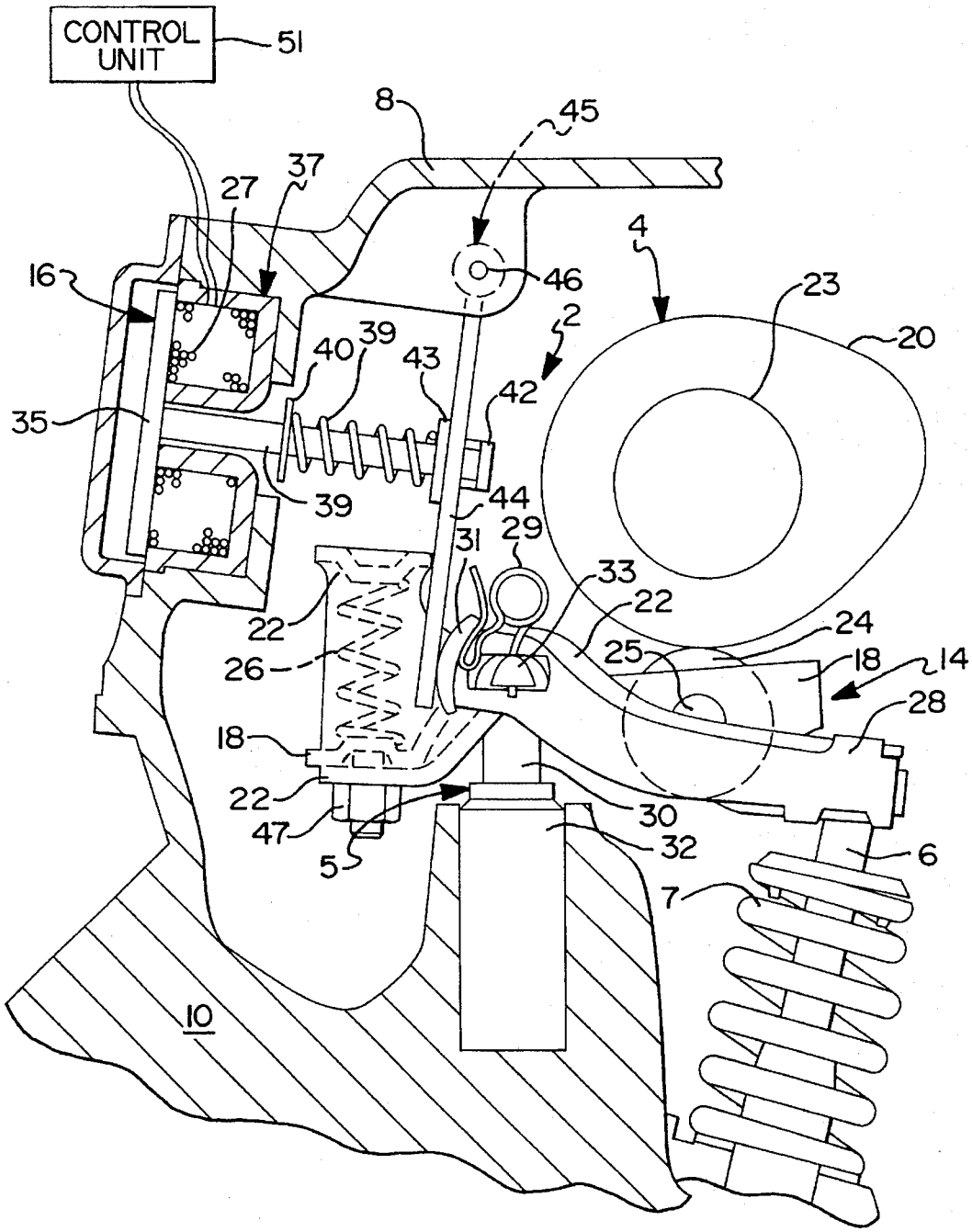
FIG. 1 is a cross sectional view of the engine poppet valve control system of the present invention installed in a valve train.

Now referring to FIG. 1 of the drawings, a cross-sectional view of the engine poppet valve control system 2 of the present invention installed as part of the valve train on an internal combustion engine is shown. A portion of an engine cylinder head 10 of an internal combustion engine of the overhead cam type is shown along with the camshaft 4, the hydraulic lash adjuster 5, the engine poppet valve 6, the valve spring 7 and the valve cover 8.

As illustrated herein, the engine poppet valve control system 2 is of the type which is particularly adapted to selectively activate or deactivate an engine poppet valve 6 and comprises a rocker arm assembly 14 which is shiftable between an active mode wherein it is operable to open the engine poppet valve 6, and an inactive mode wherein the valve is not opened; and an actuator assembly 16 which is operable to shift the rocker arm assembly 14 between its active and inactive modes through a bellcrank 44.

The rocker arm assembly 14 comprises an inner rocker arm 18 which is engageable with the valve actuating camshaft 4 at the cam lobe 20 supported on the cam base shaft 23 and the cylinder head 10 of the engine, an outer rocker arm 22 which is engageable with an engine poppet valve 6 which is maintained normally closed by a valve spring 7, a biasing spring 26 acting between the inner and outer rocker arms 18 and 22 to bias the inner rocker arm 18 into engagement with the camshaft 4 through the roller follower 24 and the outer rocker arm 22 into engagement with the plunger 30 which rides in the main body 32 of lash adjuster 5. The construction and the function of the lash adjuster 5 are well known in the art and will not be described in detail herein. The biasing spring 26 applies sufficient force to the plunger 30 to keep the lash adjuster 5 operating in its normal range of operation at all times.

A latch member 28 is slidably received on the outer rocker arm 22 and biased into a "latched" condition by latch spring 29, the latch member 28 is effective to latch the inner and outer rocker arms 18 and 22 so that they rotate together to define the active mode of the engine poppet valve control system 2 of the present invention or to unlatch them where the inner and outer rocker arms 18 and 22 are free to rotate relative one to the other to define the inactive mode. A link pin 33 passes through coaxial apertures formed in the outer rocker arm 22 and through an elongated link pin aperture 21 formed in the latch member 28 and provides a pivotal support to the outer rocker arm 22 where the inner rocker arm 18 pivots on the link pin 33 which in turn pivots on lash adjuster 5. In the preferred embodiment of the invention, the inner rocker arm 18 is pivotally mounted on link pin 33 and the outer rocker arm 22 pivotally engages the link pin 33 which supports the inner rocker arm 18 and indirectly by the plunger 30 of the lash adjuster 5. The link pin 33 passes through coaxial apertures 61A and 61B formed in the outer rocker arm (see FIG. 11) and through a link pin aperture 21 formed in the latch member 28 and provides pivotal support to the outer rocker arm 22 where the link pin 33 pivots on the plunger 30. In the preferred embodiment of the invention, the inner rocker arm 18 is pivotally supported on the link pin 33 and the outer rocker arm 22 is nonrotatably mounted on link pin 33 where the link pin 33 is pivotally supported by plunger 30 of lash adjuster 5. In other words, the link pin 33 holds the inner and outer rocker arms 18 and 22 and the latch member 28 in the proper orientation while allowing relative rotation between the inner and outer rocker arms 18 and 22, and axial motion of the latch member 28 due to the elongated link pin aperture 21 formed in both sides of latch member 28. The link pin 33 extends through the latch member 28 and the outer rocker arm 22 while the inner rocker arm 18 pivots on link pin 33 at the saddle portion 50 (see FIGS. 8, 18–20) and retains the inner rocker arm 18 and the outer rocker arm 22 and the latch member 28.

The outer rocker arm 22 is an elongated rectangular structure having opposed side walls, and a first end 22A for engaging a biasing spring 26 and a second end 22B having a valve engagement surface 22C formed thereon. The valve engagement surface 22C is in contact with the engine poppet valve 6. The inner rocker arm 18 is an elongated rectangular structure received between the opposed side walls of the outer rocker arm 22 (see FIG. 3). The inner rocker arm has a contact surface 18A formed thereon engageable with the latch member 28 when the rocker arm assembly 14 is in the normal active mode.

A nonenergized electromagnetic actuator assembly 16 allows the latch spring 29 to force the latch member 28 into a position to provide actuation of the engine poppet valve 5 by the camshaft 4 through the rocker arm assembly 14 known as the active mode. When energized by the control unit 51, the actuator assembly 16 applies a spring force to the bellcrank 44 through actuator spring 39 thereby forcing the latch member 28 into a position to provide for a loss motion between the inner and outer rocker arm 18 and 22 so that there is no mechanical actuation of the engine poppet valve 6 by the camshaft 4 known as the inactive mode as shown in FIG. 1.

The actuator assembly 16 consists of a circular armature 35 which is electromagnetically attracted toward the electromagnet 37 when an electrical current is supplied to the coil 27 by the control unit 51. The circular armature 35 is attached to an armature shaft 38 which is connected to a bellcrank 44 through a compression actuator spring 39. The actuator spring 39 pilots on the armature shaft 38 and is retained in a static position on the armature shaft 38 by retainers 40 and 43 where retainer 40 is secured to the armature shaft 38 and retainer 43 is free to slide along the armature shaft 38 while contacting the bellcrank 44 so as to apply a pushing force against the bellcrank 44 when the actuator assembly 16 is energized and the armature 35 contacts the electromagnet 37. In this manner, if the latch member 28 is vertically loaded by a clamping force generated by the inner and outer rocker arms 18 and 22 and unable to be moved into an inactive mode upon energization of the electromagnet 37, the electromagnet 37 can simply load the actuator spring 39 which provides for lost motion between the actuator 16 and the bellcrank 44 and forces the bellcrank 44 against the latch member 28. Thus, the armature 35 moves to contact the electromagnet 37 and the retainer 40 moves to compress the actuator spring 39 and apply a preload force against the bellcrank 44 through the retainer 43. As soon as the latch member 28 becomes unloaded, the preloaded actuator spring 39 forces it into a position so that the rocker arm assembly 14 is in the inactive mode. The bellcrank 44 pivots on arm pin 46 and is secured to the armature shaft 38 by retention plug 42. The bellcrank 44 contacts the latch member 28 at latch shoes 31 which are formed as part of the latch member 28 where the contact mechanism is biased toward a position to activate the engine poppet valve 6 (active mode) by the latch spring 29 which acts upon the latch shoe 31 and is secured at one end through holes formed in the link pin 33.

The biasing spring 26 is preloaded to maintain a load between the roller follower 24 rotating on roller pin 25 and the camshaft 4 sufficient to keep the lash adjuster 5 operating in its normal range of adjustment. Changes in the preload on the biasing spring 26 can be made by changing the position of the preload adjuster 47.

FIG. 1 illustrates the valve control system 2 in an inactive position where the actuator assembly 16 is energized and the armature 35 is magnetically attracted and moved to come in contact with the electromagnet 37. Armature shaft 38 acts against the actuator spring 39 pushing against the bellcrank 44 which in turn pushes against both latch shoes 31. If the rocker arm assembly is in an unloaded condition where the cam lobe 20 is contacting the roller follower 24 on the base circle, than the latch member 28 is moved against latch spring 29 so as to cause the inner rocker arm assembly 18 to become disconnected from the outer rocker arm assembly 22 so that the engine poppet valve 6 remains closed (i.e. inactive mode).

The bellcrank 44 acts as a bellcrank mechanism pivoted at one end where a pivot 45 rotating at arm pin 46 is used to translate motion supplied by an actuator to the rocker arm assembly 14. In this manner, the travel of the actuator does not have to match that required by the latch member 28 of rocker arm assembly 14 and an actuator with a low displacement can be used to supply the required motion to the latch member 28 using the bellcrank 44 to amplify the displacement.

Figure 2:
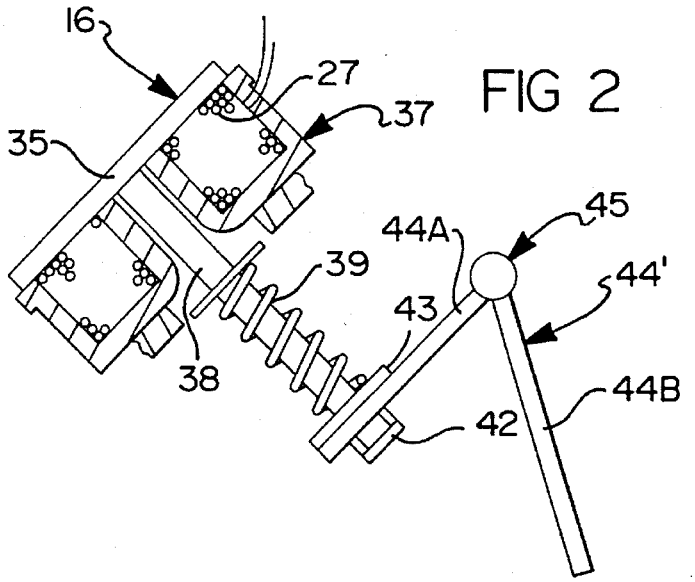
FIG. 2 is a cross sectional view of the actuator and an alternate embodiment of the bellcrank of the present invention.

Now referring to FIG. 2, an alternative embodiment bellcrank 44' is shown where a pivot 45' has been moved to be positioned between the actuator armature shaft 38 and the latch member 28. The bellcrank arm 44A is shorter than the bellcrank arm 44B to provide for travel amplification of the actuator assembly 16 in the same proportion as the ratio of the length of bellcrank arm 44B to the length of bellcrank arm 44A. Thus, using the present invention, an actuator with high force capability but low travel can be used to provide the travel required by the latch member 28 to shift the rocker arm assembly 14 from an active to an inactive position. The actuator assembly 16 is shown as an electromagnetic solenoid having a coil 27 and a armature 35 and actuator shaft 38. Other types of actuators could be used in conjunction with the bellcrank 44 to move the latch member 28 to change the operational status of the engine poppet valve 6. For example, hydraulic or pneumatic powered actuators could be used to supply the required force input to the bellcrank 44.

Figure 3:
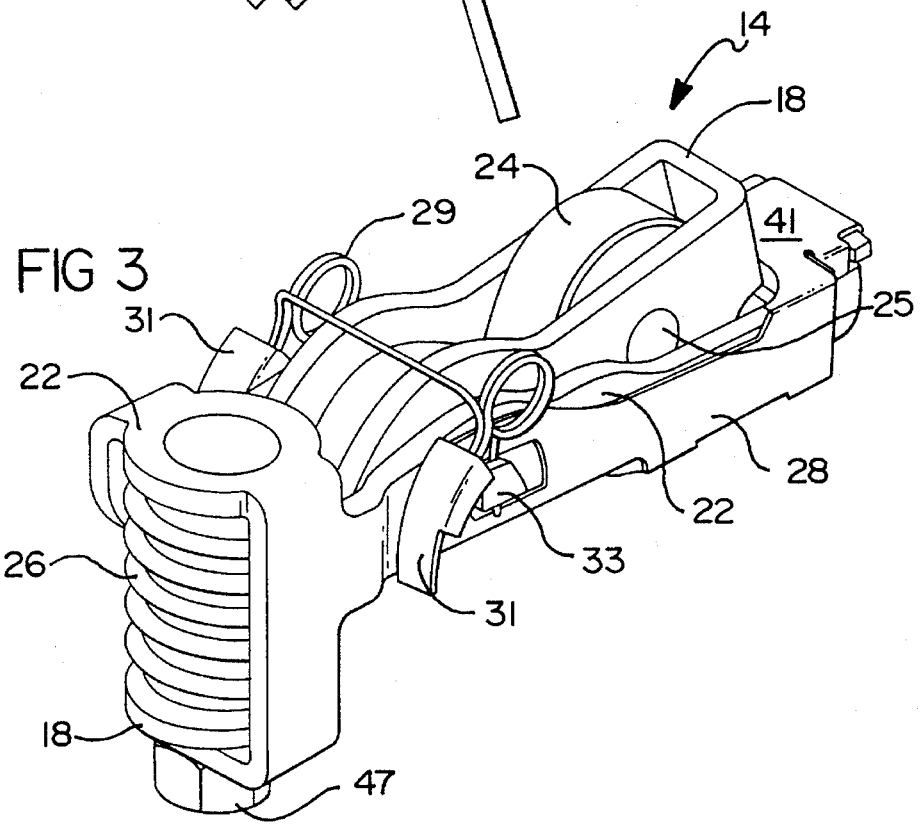

Reference to FIG. 3 is now made to provide a better understanding of the operation of the rocker arm assembly 14. The perspective view of the rocker arm assembly 14 as shown in FIG. 3 illustrates the inner rocker arm 18 surrounded by the outer arm 22 where the inner rocker arm 18 contacts and pivots on the lash adjuster 5 (see FIG. 1) while the outer rocker arm 22 contacts and actuates the engine poppet valve 5 when the latch member 28 is in the active position. The cam roller follower 24 rotates on roller pin 25 which is supported in the inner rocker arm 18. The latch member 28 is biased into the active position by the latch spring 29 which is compressed to act to press against the latch shoes 31 which are formed as part of the latch member 28.

The two ends of latch spring 29 engage a hole formed at each end of the link pin 33 respectively and retain the latch spring 29 in place. The link pin 33 also holds the inner and outer rocker arms 18 and 22 and the latch member 28 in the proper orientation while allowing relative rotation between the inner and outer rocker arms 18 and 22, and axial motion of the latch member 28 due to the elongated link pin aperture 21 formed in both sides of latch member 28. The link pin 33 extends through the latch member 28 and the outer rocker arm 22 and the inner rocker arm 18 and retains the latch spring 29 on both sides of the latch member 28.

The latch member 28 has an contact plate 41, the position of which determines when the rocker arm assembly 14 is in an active or inactive mode. When the latch member 28 is moved toward the inner rocker arm 18, the rocker arm assembly 14 is in the active mode and the latch member 28 provides a mechanical link between the inner and outer rocker arms 18 and 22 to open the engine poppet valve 6 in response to the camshaft 4 acting on the roller follower 24. When the latch member 28 is moved away from the inner rocker arm 18, the rocker arm assembly 14 is placed in an inactive mode where the inner arm 18 is not linked to the outer arm 22 and the engine poppet valve 6 is closed. As the contact plate 41, as part of the latch member 28, is moved toward the inner rocker arm 18, the contact plate 41 catches an edge of the inner rocker arm 18 and thereby mechanically links the inner and outer rocker arms 18 and 22 causing the engine poppet valve 6 to open and close in response to the cam lobe 20. As the contact plate 41 is moved away from the inner rocker arm 18, the inner rocker arm 18 no longer contacts the contact plate 41 and the inner rocker arm 18 moves in response to the camshaft 4 but its motion is not transferred to the outer rocker arm 22 or the engine poppet valve 6. When the rocker arm assembly is in the inactive mode, the inner rocker arm 18 pivots on the lash adjuster 5 at the plunger 30 and compresses the biasing spring 26 which is supported at one end by the inner rocker arm 18 and at a second end by the outer rocker arm 22. Thus, the biasing spring 26 functions to maintain contact between the cam roller follower 24 and the cam lobe 20 and to provide the proper compression load on the lash adjuster 5. The initial preload on the biasing spring 26 can be changed with the preload adjuster 47.

Now referring to FIGS. 4 and 5, both top and end views of the rocker arm assembly 14 of the present invention are shown. The inner rocker arm 18 is generally surrounded by the outer rocker arm 22 where the latch member 28 is moved to cause the contact plate 41 to contact the inner rocker arm 18 for activation of the engine poppet valve 6 (active mode) or to not contact the inner rocker arm 18 for decoupling of the inner rocker arm 18 from the outer rocker arm 22 and deactivation of the engine poppet valve 6 (inactive mode). The latch spring 29 contacts the latch shoes 31, one formed on each side, and provides a spring bias to move the latch member 28 and specifically the contact plate 41 toward the inner rocker arm 18. Thus, the latch member 28 is spring biased toward the active mode. FIG. 5 clearly shows the functioning of the preload adjuster 47 which moves the lower spring support 43 of the inner rocker arm 18 away from or closer to the outer rocker arm 22, thereby altering the preload on biasing spring 26 and the force on the roller follower 24 against the cam lobe 20. The biasing spring 26 is held between the lower spring support 43 which is part of the inner rocker arm 18 and the outer rocker arm 22.

FIG. 6 is an end view of the actuator assembly 16 connected to the rocker arm assembly 14 of the present invention. The armature 35 is shown circular in shape although a variety of shapes and configurations could be utilized as practiced in the solenoid art. Any type of actuator that responds to an electrical command signal could be used to move the bellcrank 44 as pivoted on pivot 45 and arm pin 46 toward and away from the latch shoes 31 so as to activate or deactivate the rocker arm assembly 14. Separate actuators could be used, one for each of the latch shoes 31.

As described previously, the armature 35 is magnetically attracted to the electromagnet 37 when the coil 27 is energized by the contact plate 41. The armature 35 is connected to a armature shaft 38 which pushes against the actuator spring 39 through the retainer 40 which is attached to the armature shaft 38. In this manner, when the latch member 28 cannot be moved due to the clamping forces generated when the cam lobe 20 is opening the engine valve 6 between the inner and outer rocker arm 18 and 22 on the contact plate 41, the latch member 28 is preloaded by the actuator spring 39, which has been compressed against the bellcrank 44, to move the rocker arm assembly 14 into an inactive mode as soon as the roller follower 24 encounters the base circle of the camshaft 4. Likewise, the camshaft 4 must be rotated such that the cam roller follower is on the base circle for the rocker arm assembly 14 to be shifted into the active mode since the latch member 28 must be moved so that the contact plate 41 is positioned to engage both the inner and outer rocker arm 18 and 22.

FIG. 7 is an elevational view of the inner rocker arm 18 of the present invention. The inner rocker arm 18 consists of two side walls 53, 54 and a web portion 52 connecting the side walls 53, 54. The lower spring support 43 is attached and formed as part of the web portion 52.

FIG. 8 is a cross-sectional view of the inner rocker arm 18 of FIG. 7 taken along line VIII—VIII. The web portion 52 of the inner rocker arm 18 is shown having an oil drain 49 formed in a location coinciding with the area of the inner rocker arm 18 that contacts and pivots on the plunger 30 (see FIG. 1). A pin aperture 55 is formed in both of the side walls 53 and 54 to provide for support of the roller pin 25. A saddle portion 50 contacts and pivots on the link pin 33 which in turn contacts and pivots on the plunger 30. An end portion 58 contacts the contact plate 41 (see FIG. 2) at contact surface 18A when the rocker arm assembly 14 is in the active mode (actuator assembly 16 is not energized and the latch spring 29 moves the latch member 28 into engagement).

FIG. 9 is a cross-sectional view of the inner rocker arm 18 of FIG. 7 taken along line IX—IX. The web portion 52 extends to form the lower spring support 43 on which the biasing spring 26 rides. Also the preload adjuster 47 contacts the side of the lower spring support 43 opposite to that of the biasing spring 26 to provide for adjustment of the relative length between the inner rocker arm 18 and the outer rocker arm 22 where the biasing spring 26 is mounted thereby altering the preload on the biasing spring 26.

Referring now to FIGS. 10–13, various views of the outer rocker arm 22 of the present invention are shown. FIG. 10 is a side elevational view of the outer rocker arm 22 where a link pin aperture 61B is formed in both side walls 67 and 68 to provide support for the link pin 33. At the first end 22A of the outer rocker arm 22, an upper spring support 57 is formed which, in conjunction with the lower spring support 43 found in the inner rocker arm 18 provides a secure mounting arrangement for the biasing spring 26. Thus, the biasing spring 26 provides a separation force between the inner and outer rocker arms 18 and 22 and forces the roller follower 24 into contact with the cam lobe 20 and loads the plunger 30 of the lash adjuster 5. A valve contact pad 59 is provided at the second end 22B of the outer rocker arm 22 for contacting the top of the valve stem of engine poppet valve 6 at valve engagement surface 22C.

FIG. 11 is a top view of the outer rocker arm 22 of FIG. 10 more clearly showing the side walls 67 and 68 and both link pin apertures 61A and 61B. FIG. 12 in an end view of the outer rocker arm 22 of FIG. 10 more clearly showing the valve contact pad 59 which contacts the end of the engine poppet valve 6 at the valve engagement surface 22C thereby transferring the motion provided by the camshaft 4 and the inner rocker arm 18 to the engine poppet valve 6 when the rocker arm assembly 14 is in an active mode. It also illustrates how the side wall 68 is formed to provide a support portion 69 for the preload adjuster 47 (see FIGS. 1 and 5). FIG. 13 is a cross-sectional view of the outer rocker arm 22 of FIG. 10 taken along line XIII—XIII. FIG. 13 shows how the support portion 69 extends to provide a provision for the retention of the preload adjuster 47. The adjuster opening 70, formed in the support portion 69 can be drilled and tapped to provide the required method of retention. Note that only the side wall 68 is shown since the side wall side wall 67 does not extend to the area of the preload adjuster 47.

FIG. 14 is an elevational view of the latch member 28 of the present invention showing the contact plate 41 and one of the latch shoes 31A. A link pin aperture 21 allows the link pin 33 to extend therethrough and provides a location function to the latch member 28. The link pin aperture 21 is elongated to provide clearance for the movement of the latch member 28 to the active and inactive positions. FIG. 15 is a top view of the latch member 28 of FIG. 14 showing the side walls 73 and 75 which are joined at one end to form the contact plate 41 and their opposite ends are bent to form individual latch shoes 31A and 31B respectively.

FIGS. 16 and 17 illustrates an elevational and top view of the latch spring 29 of the present invention. The latch spring 29 provides a force to the latch member 28 operating against the link pin 33 that pushes the latch shoes 31A and 31B away from the link pin 33 which in turn pulls the contact plate 41 into contact with the inner rocker arm 18 at contact surface 18A which causes the rocker arm assembly 14 to actuate the engine poppet valve 6 (the active mode) when the actuator 16 is non-energized. The contact arms 80A and 80B press against their respective latch shoes 31A and 31B respectively and react through the spring coils 84A, 84B to the link pin 33 where the spring coils 84A, 84B are attached to the link pin 33 by engagement of the extension arms 82A, 82B through engagement holes formed in the ends of the link pin 33 on either side of the latch member 28.

FIG. 18 is a cross-sectional view of the link pin 33 showing the pivoting section 96 where the link pin 33 contacts and pivots on the plunger 30. Also shown is the oil passageway 94 which extends from the pivoting section 96 allowing lubricant from the lash adjuster 5. The extension pins 92A and 92B extend to support and guide the latch member 28. Clip apertures 90A and 90B are formed in the extension pins 92A and 92B respectively and function to retain the latch spring 29 in position to react against the latch shoes 31.

FIG. 19 is an end view of the link pin 33 showing the semicircular shape which allows the saddle portion 50 (see FIG. 8) of the inner rocker arm 18 to pivot on top of the link pin 33.

Now referring to FIG. 20, a cross-sectional view of the inner rocker arm 18 rotatably supported at the saddle portion 50 on the link pin 33 which is rotatably supported on the plunger 30 is shown. A center oil passage 98 formed in the plunger 30 allows lubricant to flow onto the link pin 33 and onto the inner rocker arm 18 for reducing the level of friction when the link pin 33 rotates on the plunger 30 and the inner rocker arm rotates on the link pin 33 and when the inner rocker arm 18 rotates relative to the outer rocker arm 22.

While the invention has been illustrated and described in some detail in the drawings and foregoing description, the same is to be considered as illustrative and not restrictive in character, it being understood that only the preferred embodiment has been shown and described and that all changes and modifications that come within the spirit of the invention are to be considered within the scope of the invention and only limited by the following claims.

We claim:

1. A vane control system for an internal combustion engine including a cylinder head, an engine poppet valve, and a camshaft having a cam lobe formed thereon said control system comprising:

means on said cylinder head defining a pivot point;

a link pin adapted to rotate about said pivot point;

an outer rocker arm nonrotatably supported on said link pin and engageable with said engine poppet valve;

an inner rocker arm having a saddle portion for rotatably contacting said link pin and adapted to rotate relative to said outer rocker arm, said inner rocker arm engaging said cam lobe;

a biasing spring for forcing said outer rocker arm into engagement with said engine poppet valve and said inner rocker arm into engagement with said cam lobe;

a slidable latch member for selectively linking said inner and said outer rocker arms for rotation in unison with said link pin about said pivot point in response to a force applied by said cam lobe to said inner rocker arm, and for selectively unlinking said inner and said outer rocker arms for independent rotation, said latch member extending from approximately one end of said outer rocker arm at said poppet valve along said outer rocker arm toward said link pin;

actuation means for applying a force to said latch member in response to an activation signal from a control unit for selectively unlinking said inner and said outer rocker arms; and a latch spring disposed to apply a separation force between said link pin and said latch member for maintaining engagement of said inner rocker arm with said latch member and said outer rocker arm when said activation means is nonenergized.

2. The valve control system of claim 1, further comprising a cam follower mounted on said inner rocker arm for engaging said cam lobe.

3. The valve control system of claim 2, wherein said cam follower is a roller follower.

4. The valve control system of claim 1, wherein said outer rocker arm is an elongated rectangular structure having opposed side walls and a first end for engaging said biasing spring and a second end having a valve engagement surface formed thereon.

5. The valve control system of claim 4, wherein said inner rocker arm comprises an elongated rectangular structure received between the opposed side walls of said outer rocker arm, said inner rocker arm having a contact surface formed thereon engageable with said latch member when said inner and outer rocker arms are in an active position.

6. The valve control system of claim 5, wherein said contact surface contacts said latch member on a contact plate, said contact plate formed as part of said latch member and adapted to be supported by said outer rocker arm.

7. The valve control system of claim 1, wherein said actuation means is a solenoid acting on a bellcrank, said bellcrank having a first end contacting and axially displacing said latch member.

8. The valve control system of claim 7, wherein said bellcrank has a pivot where said pivot is disposed at a second end of said bellcrank.

9. The valve control system of claim 8, wherein said bellcrank has a pivot disposed between said first end and said second end of said bellcrank.

* * * * *